United States Patent [19]

Rosenfeld et al.

[11] Patent Number: 5,067,194

[45] Date of Patent: Nov. 26, 1991

[54] SANITARY DEVICE

[76] Inventors: Anne Rosenfeld, 83-15 Lefferts Blvd., Kew Gardens, N.Y. 11415; Frank Barkman, 35-11 85th St., Jackson Heights, N.Y. 11372

[21] Appl. No.: 335,914

[22] Filed: Apr. 10, 1989

[51] Int. Cl.[5] ..... A47K 10/16

[52] U.S. Cl. ..... 15/144 A; 15/145; 15/244.1; 15/210 R; 604/1

[58] Field of Search ..... 15/210 R, 145, 244.1, 15/144 A; 300/21; 604/1

[56] References Cited

U.S. PATENT DOCUMENTS

| | | | |
|---|---|---|---|
| 1,478,388 | 12/1923 | Gray | 15/244.1 |
| 1,741,969 | 12/1929 | Bellows | 403/348 X |
| 2,864,114 | 12/1958 | Schostal | 15/244.1 |
| 2,927,335 | 3/1960 | Hammond | 15/244.1 |
| 3,228,398 | 1/1966 | Leonard et al. | 15/244.1 |
| 3,935,611 | 2/1976 | Locher | 15/160 |
| 4,075,033 | 2/1978 | Knox et al. | 15/210 R |
| 4,399,582 | 8/1983 | Ernest et al. | 15/145 X |
| 4,493,124 | 1/1985 | Agapiou | 15/210 R |
| 4,592,109 | 6/1986 | Borea et al. | 15/144 R |
| 4,796,325 | 1/1987 | Bortman | 15/144 A |

FOREIGN PATENT DOCUMENTS

| | | | |
|---|---|---|---|
| 657460 | 9/1951 | United Kingdom | 15/244.1 |

*Primary Examiner*—Frankie L. Stinson
*Attorney, Agent, or Firm*—Jordan and Hamburg

[57] ABSTRACT

A sanitary device comprises a handle having a free proximal end and a distal end for mounting a shaft. A shaft extends from the distal end of the handle and has a proximal end fixed to the distal end of the handle and a distal end for mounting a wiper member. The wiper member has a proximal end fixed to the distal end of the shaft and a free distal end. The handle and the wiper member each have a widthwise dimension approximately normal to the shaft, and the respective widthwise dimensions of the handle and the wiper member are rotationally offset from each other.

8 Claims, 1 Drawing Sheet

FIG. 1
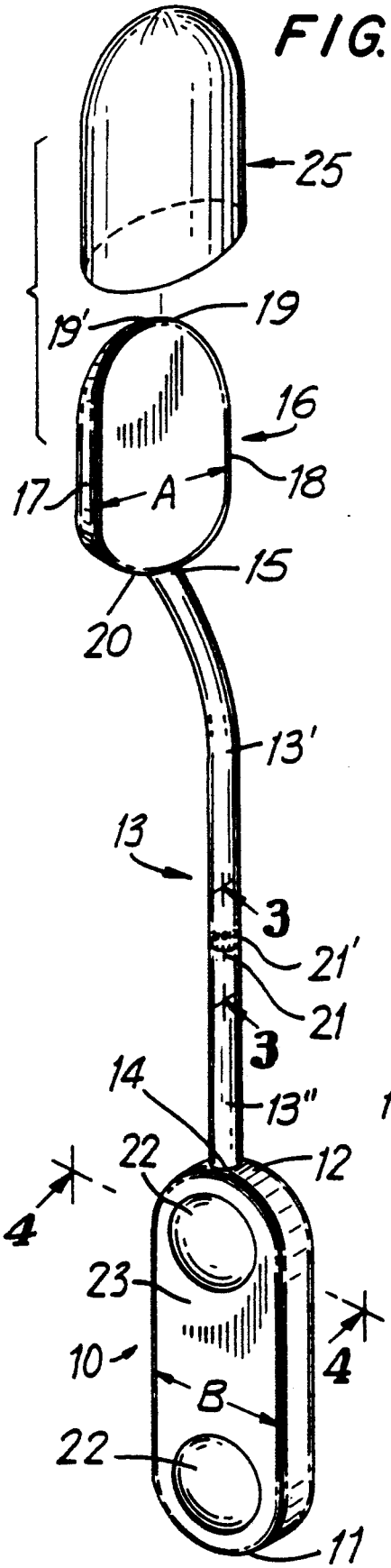
FIG. 2
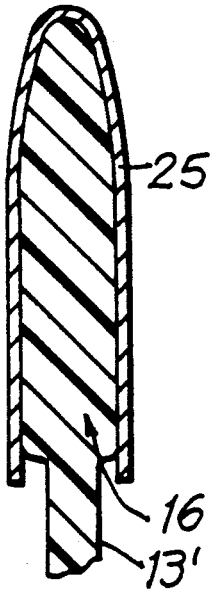
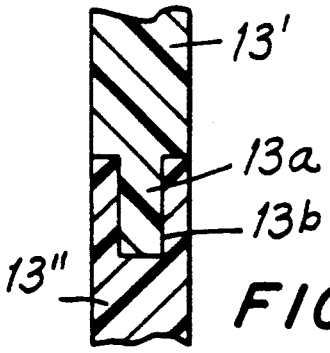
FIG. 3
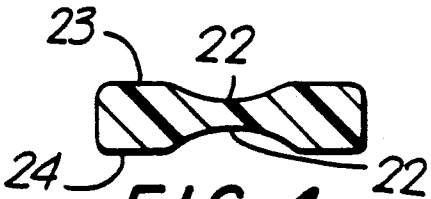
FIG. 4

SANITARY DEVICE

BACKGROUND OF THE INVENTION

This invention relates to a sanitary device. More particularly, the sanitary device of the invention is intended for use for cleansing after bowel movements by a person having limited range of motion, such as due to physical impairment or morbid obesity.

SUMMARY OF THE INVENTION

The invention provides a sanitary device comprising a handle having a proximal end which is free and a distal end for mounting a shaft, a shaft extending from the distal end of the handle and having a proximal end fixed to the distal end of the handle and a distal end for mounting a wiper member, the wiper member having a proximal end fixed to the distal end of the shaft and a free distal end, the handle and the wiper member each having a widthwise dimension approximately normal to the shaft and the respective widthwise dimensions of the handle and the wiper member being rotationally offset from each other.

BRIEF DESCRIPTION OF THE DRAWINGS

The invention will now be further described by reference to a preferred embodiment, as illustrated in the drawings, in which:

FIG. 1 is a perspective view of a device according to the invention with a pocket-shaped wiper thereof illustrated as separated therefrom;

FIG. 2 is a sectional view of the wiper member of the device with the wiper received thereon;

FIG. 3 is a sectional view taken on section plane 3—3 of FIG. 1; and

FIG. 4 is a sectional view taken on section plane 4—4 of FIG. 1.

DETAILED DESCRIPTION OF A PREFERRED EMBODIMENT

A sanitary device according to the invention includes a handle 10 having a proximal end 11 and a distal end 12. A shaft 13 is mounted on the distal end 12 of the handle 10, the proximal end 14 of the shaft 13 being fixed to the handle 10. Fixed to the distal end of the shaft 13 is a wiper member 16. The wiper member 16 tapers laterally so that it has a wider lateral edge 17 and a narrower lateral edge 18. The wiper member also tapers lengthwise so that the edge thereof 19' at its distal end 19 is narrower than the edge thereof at its proximal end 20.

The shaft 13 consists of two parts, part 13' being fixed to the wiper member 16 and part 13'' being fixed to the handle 10. The shaft parts 13', 13'' are disconnectably connected to each other by means of a press fit, the part 13' having a male cylindrical extension **13*a* which is received in a cylindrical blind bore or socket the shaft parts 13', 13*b* in the part 13''. Disconnecting 13'' from each other results in the device being in two parts of shorter length than the whole, for ease of carrying: further to that end, a carrying case may be provided for the disassembled device. The press fit also makes it possible to manually rotate the parts 13', 13'' relative to each other, the frictional resistance provided by the press fit being sufficient, however, to prevent the parts 13', 13''** from rotating relative to each other during normal use of the device.

For the convenience of the user, the part 13'' may be inscribed with an indicator 21 in the form of a vertical line at the juncture of parts 13', 13'' and the part 13' may be inscribed with indicia 21' including a plurality of equally spaced vertical lines arranged on part of the circumference of the part 13'' at its juncture with the the part 13'. Preferably, the parts 13', 13'' have a "normal" rotational orientation relative to each other in in which the principal plane of the wiper member 16 and the principal plane of the handle 10 are at right angles to each other. Another way of likewise expressing the relative rotational orientation is in terms of rotational displacement of widthwise dimension A of the wiper member 16 relative to widthwise dimension B of the handle 10. Widthwise dimensions A and B lie in or are parallel to the respective principal planes of the wiper member 16 and the handle 10. Consequently, rotational offset of the widthwise dimensions A and B relative to each other is the same as rotational offset of the aforementioned principal planes relative to each other. In practical, everyday terms, the rotational offset may be expressed as and will be readily understood by the average person as rotational offset of the handle 10 and the wiper member 16 relative to each other. In the particular embodiment illustrated in FIG. 1, the indicia 21' include a vertical line or indicator about which the other vertical lines of the indicia 21 are centered. The middle vertical line or indicator is incribed with "0" to indicate that when the so inscribed indicator is aligned with the indicator 21, the rotational offset of the handle 10 and the wiper member 16 is set at "normal", namely 90°. Clockwise and counterclockwise of the zero or normal indicator are respective indicator lines inscribed with "1" and "2", respectively, indicating, respectively, 22½° and 45° rotations from the normal position. This is, of course, merely exemplary. However, in practice, most users will find a 90°±45° rotational offset to be most convenient. The indicia 21, 21' make it convenient for the user each time to reassemble the device at the orientation preferred by the user. If the shaft 13 is of unitary construction or the device is otherwise so constructed that the rotational offset cannot be changed, the fixed rotational offset preferably will be 90°.

As illustrated, the widthwise dimension A of the wiper member 16 and the widthwise dimension B of the handle 11 are essentially normal to the shaft 13. Generally, the relationship in each instance will be at least approximately normal. In the illustrated embodiment, an imaginary extension of the axis of the shaft part 13'' would be in the principal plane of the handle 10, whereas an imaginary extension of the axis of shaft part 13' forms a small angle with the principal plane of the wiper member 16 because the shaft part 13' has a bend formed in it to provide a lateral offset of the wiper member 16 relative to the lengthwise center line of the handle 11 to facilitate proper positioning of the wiper member 16 in use. Generally, in each instance, the imaginary extension of the axis will, as in the present case, be at least approximately in the principal plane of the wiper member or of the handle, respectively.

Near the proximal 11 and distal 12 ends of the handle 10 are provided identical thumb indentations 22 in both principal faces 23 and 24 of the handle 10. The purpose of the thumb indentations being adjacent both ends of the handle 10 is to facilitate gripping of the handle by the user with the device initially projecting either away from or toward the user, to account for limitations of movement, personal preference and selection of which hand to use varying from user to user.

How the user grips the handle 10 will also be determined by which of the edges 17 and 18 the user prefers as the leading edge during wiping. Also, depending on how a particular user manipulates the device, the edge 19' of the distal end 19 may act as an extension of whichever of edges 17 and 18 is used as the leading edge.

Before the device is used, a pocket-shaped disposable wiper 25 is received on the wiper member 16 The disposable wiper is preferably fabricated of paper or paper-like material already in common use as "wipes" in sheet form. After use, the wiper 25 is readily flushed away in the toilet merely by holding the device with the wiper member 16 projecting downwardly into the toilet whereupon the wiper 25 will fall into the toilet by itself or with the aid of a flush of the toilet.

What we claims is:

1. A sanitary device comprising a handle having a free proximal end and a distal end for mounting a shaft, a shaft extending from the distal end of the handle and having a proximal end fixed to the distal end of the handle and a distal end for mounting a wiper member, the wiper member having a wider lateral edge and a narrower lateral edge and also having a proximal end fixed to the distal end of the shaft and a free distal end, the handle and the wiper member each having a widthwise dimension approximately normal to the shaft and the respective widthwise dimensions of the handle and the wiper member being rotationally offset from each other, the handle and the wiper member each having a thickness substantially less than the widthwise dimension thereof and said thickness being normal to the shaft and to the widthwise dimension, the shaft comprising two parts including joint means rotatably connecting together the two shaft parts at a position between the handle and the wiper member whereby the handle and the wiper member are infinitely rotationally adjustable relative to each other thereby to adjust the rotational offset and further comprising indicia on the two shaft parts for indicating the relative extend of the rotational offset.

2. A sanitary device according to claim 1, in which the rotational offset is from about 45° to about 135°.

3. A sanitary device according to claim 1, in which the two shaft parts are detachable from each other at said joint means, whereby the device can readily be partially disassembled by disconnecting the two parts of the shaft for greater ease of storage and carrying of the device.

4. A sanitary device according to claim 1, in which the joint means comprises a female socket in one of the shaft parts and a male extension formed on the other of the shaft parts for press fit receipt in the socket, the press fit permitting manual rotational displacement of the two shaft parts relative to each other thereby to effect said rotational adjustability of the wiper member and the handle relative to each other.

5. A sanitary device according to claim 1, in which the handle is symmetrical so as to facilitate use thereof by gripping of the handle.

6. A sanitary device according to claim 5, further comprising thumb depressions in the handle near both ends thereof to facilitate use thereof by gripping the handle.

7. A sanitary device according to claim 1, further comprising thumb depressions in the handle near both ends thereof to facilitate use thereby by gripping the handle.

8. A sanitary device according to claim 1, further comprising a disposable pocket-shaped wiper for being received on the wiper member.

* * * * *